US006917913B2

(12) United States Patent
Law et al.

(10) Patent No.: US 6,917,913 B2
(45) Date of Patent: Jul. 12, 2005

(54) DIGITAL FILTER FOR SUB-BAND SYNTHESIS

(75) Inventors: Kwok Wah Law, Tin Shui Wai (HK); Ka Chun Kenneth Lee, Shatin (HK)

(73) Assignee: Motorola, Inc., Schaumburg, IL (US)

( * ) Notice: Subject to any disclaimer, the term of this patent is extended or adjusted under 35 U.S.C. 154(b) by 800 days.

(21) Appl. No.: 09/803,748

(22) Filed: Mar. 12, 2001

(65) Prior Publication Data

US 2002/0173967 A1 Nov. 21, 2002

(51) Int. Cl.[7] ..... G10L 19/00
(52) U.S. Cl. ..... 704/212; 704/500
(58) Field of Search ..... 704/500, 200, 704/212

(56) References Cited

U.S. PATENT DOCUMENTS

| | | | | | |
|---|---|---|---|---|---|
| 5,508,949 | A | * | 4/1996 | Konstantinides | 708/402 |
| 5,675,703 | A | * | 10/1997 | Sato | 704/230 |
| 5,812,979 | A | * | 9/1998 | Han et al. | 704/501 |
| 6,094,637 | A | * | 7/2000 | Hong | 704/500 |
| 6,421,695 | B1 | * | 7/2002 | Bae et al. | 708/402 |

OTHER PUBLICATIONS

Konstantinos Konstantinides, Fast Subband Filtering in MPEG Audio Coding, IEEE Signal Processing Lettters, vol. 1, No. 2., Feb. 1994, pp. 26–28 (1970–990894).*

Myung Jun Kim, et al. An Efficient Video Down Conversion Algorithm Using Modified IDCT Basis Funcitions, IEEE 0–7803– 5467–Feb. 1999, pp. 914–918.*

Vladimir Britanak, et al. An Efficient Implementation of the Forward and Inverse MDCT in MPEG Audio Coding, IEEE Signal Processing Letters, vol. 8, No. 2. Feb. 2001 (1070–9908/01).*

* cited by examiner

*Primary Examiner*—Daniel Abebe

(57) ABSTRACT

In a MPEG audio decoding process, an IDCT (Inverse Discrete Cosine Transform) process that generates time domain samples from frequency domain samples using a very limited number of prestored cosine coefficients is performed. Only the cosine coefficients that satisfy cos(π*(i/64)) where i=0–32 are prestored. The cosine coefficients for i=33–63 are calculated using the prestored coefficients by changing a sign of a corresponding symmetrical one of the stored coefficients, respectively. Then, sixty-four time domain samples ($V_i$) are generated from thirty-two frequency domain samples ($S_k$) according to the equation $$V_i = \sum_{k=0}^{31} \cos((\pi/64)(i+16)(2k+1)) \times S_k$$

where i=0 to 63, using only the prestored cosine coefficients and the calculated cosine coefficients.

17 Claims, 2 Drawing Sheets

-PRIOR ART-

-PRIOR ART-

DIGITAL FILTER FOR SUB-BAND SYNTHESIS

BACKGROUND OF THE INVENTION

1. Field of the Invention

The present invention relates to digital filters and more particularly to a sub-band decoder having a reduced memory size and a method of performing an inverse discrete cosine transform that generates time domain samples from frequency domain samples using a limited number of prestored cosine coefficients.

2. Description of Related Art

Audio and video files, before being compressed, typically consist of 16 bit samples recorded at a sampling rate more than twice the actual audio bandwidth (e.g., 44.1 kHz for Compact Disks), which yields more than 1.4 Mbit to represent just one second of stereo music in CD quality. Since such vast amounts of data are unwieldy, data compression is required.

MPEG (Motion Picture Experts Group) provides standards for compressing digital audio and video signals. MP3 (MPEG Layer 3) is the MPEG layer 3 audio standard. Using MPEG audio coding, the original sound data can be reduced by a factor of 12, without sacrificing sound quality. Audio data in an MPEG compatible data stream is commonly referred to as the audio sub-band. According to MPEG standards, the audio sub-band contains sets of 32 code values that are frequency domain samples $S_k$. Decoding 32 frequency domain samples $S_k$, where k is a frequency index and ranges from 0 to 31, generates 64 time domain sound samples $V_i$, where i is a time index and ranges from 0 to 63. Recently MP3 audio files have become very popular and as a result, MP3 has become the de facto standard for storing audio files, with many MP3 files available on the Internet and many programs that support the MP3 standard.

FIG. 1 is a schematic block diagram of a conventional MP3 decoder 10. The decoder 10 receives an encoded MP3 bit stream and converts it to an analog audio output signal that is a single PCM coded signal that sounds identical to the original audio signal. More specifically, the MP3 bit stream is a sequence of many frames, each containing a header, error checking bits, miscellaneous information, and encoded data.

At block 12, the MP3 bit stream is received and upon detection of a sync-word indicating the start of a frame, the decoder 10 identifies the header and side information. Next, at block 14, the decoder 10 obtains scale factors. Then, the decoder 10 must decode the samples, which are coded using Huffman codes, at block 16. Huffman coding can pack audio data very efficiently. Further, Huffman coding is lossless because no noise is added to the audio signal.

After a bit pattern is decoded, it is dequantized at block 18 using a non-linear dequantization equation, and at block 20, reorder, anti-alias and stereo processing are performed on the samples. Next, at block 22, an Inverse Modified Discrete Cosine Transform (IMDCT) is performed on the frequency domain samples. Finally, at block 24, sub-band synthesis is performed to transform the frequency domain sub-band sample back to a time domain PCM audio signal. The sub-band synthesis is the most computation intensive part of the signal processing, typically taking more than half of the total decoding time.

Sub-band synthesis has two main parts, an IDCT (Inverse Discrete Cosine Transform) process that generates time domain samples from frequency domain samples and a windowing process that generates the final PCM output signal. More particularly, the IDCT process generates 64 samples ($V_i$) from 32 input sub-band samples ($S_k$). Using direct matrix processing, for i=0 to 63, $$V_i = \sum_{k=0}^{31} \cos((\pi/64)(i+16)(2k+1)) \times S_k \tag{1}$$

requires about 2,000 additions and about 2,000 multiplications to be performed.

In addition, when the decoder 10 is implemented with a DSP, MCU, microprocessor or dedicated hardware that processes data in real-time, the cosine coefficients must be obtained quickly. One conventional method of obtaining the cosine coefficients is to calculate them directly using an estimation method or by calling a library cosine function. Each calculation/estimation of cos requires greater than 60 cycles.

Referring to FIG. 2, a second conventional method is to store the coefficients in a 32×64 array. FIG. 2 shows a 32×64 matrix of cosine coefficients, where $C=\cos((\pi/64)(i+16)(2k+1))$. Assuming each coefficient is stored in a 32 bit memory space, then 8 k bytes of memory are required (32×64×4 bytes/word=8192 bytes).

Yet another known method of obtaining the cosine coefficients is to extract and store only certain, symmetric ones of the coefficients, as disclosed in U.S. Pat. No. 6,094,637. According to this patent, the 32×64 matrix is reduced to 16×32, which requires that only 496 coefficients be stored. However, storing 496 coefficients still requires 1984 bytes of memory (496×4 bytes/word=1984).

While large tables are readily formed without concern for the amount of memory used by decoders such as in MP3 players implemented on personal computers, with the increase in the popularity of MP3 files for storing music, there has been a corresponding increase in the demand for miniature stand-alone MP3 devices and other, small portable devices such as mobile telephones and personal digital assistants (PDAs) capable of playing MP3 encoded music. It would be beneficial if this memory requirement could be further reduced for such portable devices without requiring a large corresponding increase in computational requirements.

SUMMARY OF THE INVENTION

The present invention provides a digital filter for sub-band synthesis that prestores only predetermined ones of the cosine coefficients required to perform an inverse discrete cosine transform process that generates time domain samples from frequency domain samples. The present invention further provides a method of performing an IDCT process that generates time domain samples from frequency domain samples using prestored cosine coefficients and cosine coefficients calculated using the prestored coefficients.

Accordingly, a first embodiment of the invention provides, in a digital filter for sub-band synthesis, a method of performing an IDCT process that generates time domain samples from frequency domain samples using prestored cosine coefficients, including the steps of prestoring only the cosine coefficients that satisfy $\cos(\pi*(i/64))$ for i=0 to 32, and calculating cosine coefficients for i=33 to 63 using the prestored coefficients by changing a sign of a corresponding symmetrical one of the stored coefficients, respectively.

A second embodiment of the invention provides, in a digital filter for sub-band synthesis, a method of performing an IDCT process that generates time domain samples from frequency domain samples using prestored cosine coefficients, including the step of prestoring only the cosine coefficients that satisfy cos(π*(i/64)) for i=0 to 63.

The invention further provides, in a digital filter for sub-band synthesis, a method of performing an IDCT process that generates time domain samples from frequency domain samples using prestored cosine coefficients, including the steps of prestoring only the cosine coefficients that satisfy cos(π*(i/64)) where i=0–32, calculating the cosine coefficients for i=33–63 using the stored coefficients by changing a sign of a corresponding symmetrical one of the stored coefficients, respectively, and generating sixty-four samples ($V_i$) from thirty-two sub-band samples ($S_k$) according to the equation, $$V_i = \sum_{k=0}^{31} \cos((\pi/64)(i+16)(2k+1)) \times S_k$$

for i=0 to 63, using the prestored cosine coefficients and the calculated cosine coefficients.

In a third embodiment, the invention provides a method of performing an IDCT process that generates time domain samples ($V_i$) from frequency domain samples ($S_k$) using prestored cosine coefficients, where i and k are integer values defining columns and rows respectively of a matrix of cosine coefficients. The method includes the steps of prestoring the cosine coefficients C(k−1,i) and C(k−2,i) for each column of the matrix, prestoring an adjustment value cos(E(i)) for each column of the matrix, and calculating the cosine coefficients for the remaining locations in the matrix using the prestored coefficients and the prestored adjustment values in accordance with the equation C(k,i)=2 cos(E(i))*C(k−1,i)−C(k−2,i).

Yet another embodiment of the invention provides a method of performing an IDCT process that generates time domain samples ($V_i$) from frequency domain samples ($S_k$) using prestored cosine coefficients, where i and k are integer values defining columns and rows respectively of a matrix of cosine coefficients, including the steps of prestoring the cosine coefficients C(k,i) and C(k−1,i) for each column of the matrix, prestoring an adjustment value cos(E(i)) for column of the matrix, and calculating the cosine coefficients for the remaining rows and columns of the matrix using the prestored coefficients and the prestored adjustment values in accordance with the equation, C(k+1,i)=2 cos(E(i))*C(k,i)−C(k−1,i).

The present invention further provides a digital filter for sub-band synthesis that includes a memory for prestoring only the cosine coefficients that satisfy cos(π*i/64) for i=0 to 32, and a processor, connected to the memory for receiving the prestored cosine coefficients, for performing an IDCT process that generates time domain samples from frequency domain samples using the prestored cosine coefficients, wherein the processor calculates cosine coefficients for i=33 to 63 using the prestored coefficients by changing a sign of a corresponding symmetrical one of the prestored coefficients, respectively.

The invention also provides a digital filter for sub-band synthesis, comprising a memory for prestoring only the cosine coefficients that satisfy cos(π*(i/64)) for i=0 to 63 and a processor, connected to the memory and receiving the prestored cosine coefficients, for performing an IDCT process that generates time domain samples from frequency domain samples using the prestored cosine coefficients, wherein the processor generates sixty-four time domain samples ($V_i$) from thirty-two frequency domain samples ($S_k$) according to the equation $$V_i = \sum_{k=0}^{31} \cos((\pi/64)(i+16)(2k+1)) \times S_k$$

for i=0 to 63, using only the prestored cosine coefficients.

The present invention also provides a digital filter for sub-band synthesis via an IDCT process that generates time domain samples ($V_1$) from frequency domain samples ($S_k$), where i and k are integer values defining columns and rows respectively of a matrix of cosine coefficients, the digital filter comprising a memory for prestoring the cosine coefficients C(k−1,i) and C(k−2,i) for each column of the matrix and an adjustment value cos(E(i)) for each column of the matrix, and a processor for calculating the cosine coefficients for the remaining locations in the matrix using the prestored coefficients and the prestored adjustment values in accordance with the equation C(k,i)−2 cos(E(i))*C(k−1,i)−C(k−2,i).

Finally, the present invention provides a digital filter for sub-band synthesis via an IDCT process that generates time domain samples ($V_i$) from frequency domain samples ($S_k$), where i and k are integer values defining columns and rows respectively of a matrix of cosine coefficients, the digital filter comprising a memory for prestoring the cosine coefficients C(k,i) and C(k−1,i) for each column of the matrix and an adjustment value cos(E(i)) for each column of the matrix, and a processor for calculating the cosine coefficients for the remaining rows and columns of the matrix using the prestored coefficients and the prestored adjustment values in accordance with the equation, C(k+1,i)=2 cos(E(i))*C(k,i)−C(k−1,i).

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments that are presently preferred. It should be understood, however, that the invention is not limited to the precise arrangements and instrumentalities shown. In the drawings.

DETAILED DESCRIPTION OF PREFERRED EMBODIMENTS

Figure 1:
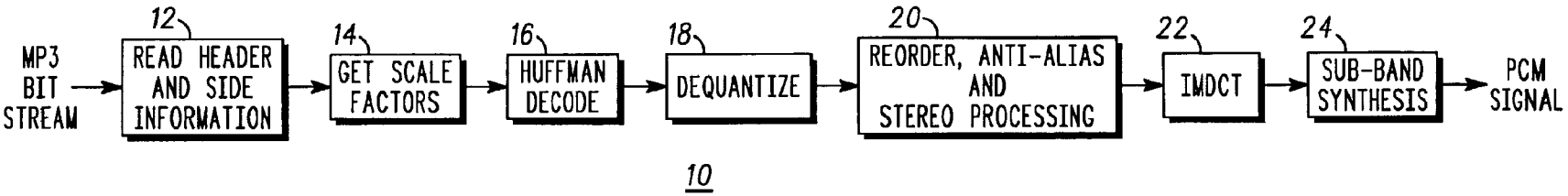
FIG. 1 is a schematic block diagram of a conventional MP3 decoder.

In the drawings, like numerals are used to indicate like elements throughout.

The present invention provides a digital filter for sub-band synthesis that processes input data and calculates the cosine coefficients in parallel and does not require a large amount of memory for storing cosine coefficients. The present invention further provides a method for performing an IDCT process that generates time domain samples from frequency domain samples using prestored cosine coefficients.

As discussed above, known methods of performing the IDCT process require a relatively large amount of memory to store the cosine coefficients. According to the present invention, the number of cosine coefficients stored is reduced and the others are calculated. However, because of the cosine coefficients selected to be stored, such calculation is performed very quickly.

Figure 3:
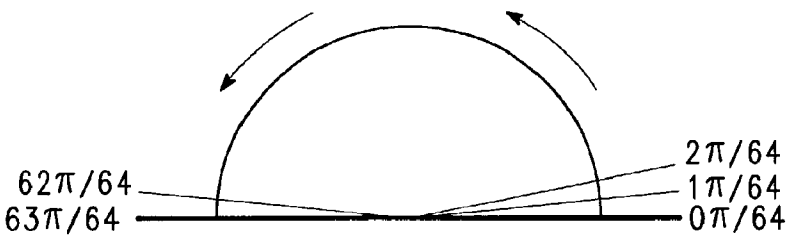
FIG. 3 is a graph showing cosine values stored in a memory according to a first embodiment of the present invention.

Analyzing the equation used to perform IDCT, for i=0 to 63, $$V_i = \sum_{k=0}^{31} \cos((\pi/64)(i+16)(2k+1)) \times S_k$$

it can be seen that there are many duplicates in the 32×64 matrix. First observe that i and k are positive integers, so (i+16)(2k+1) must be some integer. Hence we only need to store cos(π*i/64), or 64 cosine coefficients. FIG. 3 is a graph illustrating the 64 cosine values prestored in a memory according to a first embodiment of the invention. The other 1984 coefficients of the 32×64 matrix have values that are the same as the 64 stored values. Thus, according to the first embodiment of the invention, the cosine coefficients that satisfy the equation cos(π*i/64) for i=0 to 63, are prestored in a memory. Then, the time domain samples ($V_i$) are calculated from the frequency domain samples ($S_k$) according to the equation (1) above using the prestored cosine coefficients.

Figure 4:
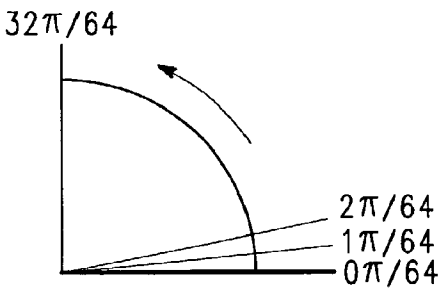
FIG. 4 is a graph showing cosine values stored in a memory according to a second embodiment of the present invention.

The first embodiment stores 64 cosine coefficients. However, this number can be reduced further. Referring to FIG. 4, a graph showing cosine values stored in a memory according to a second embodiment of the invention is shown. The graph of FIG. 4 shows that the number of coefficients stored can be halved because the cosine values in the range (0π/64 . . . 31π/64) are an exact mirror of the cosines values in the range (64π/64 . . . 33π/64), with the opposite sign. For example, 33π/64=−(31π/64). Thus, according to the second embodiment of the invention, only 33 cosine coefficients are prestored in memory. That is, according to the second embodiment, only the cosine coefficients that satisfy cos(π*i/64) for i=0 to 32 are prestored in memory and the cosine coefficients for i=33 to 63 are calculated using the prestored coefficients simply by changing a sign of a corresponding symmetrical one of the stored coefficients. Then, the time domain samples ($V_i$) are calculated from the frequency domain samples ($S_k$) according to the equation (1) above, using only the prestored cosine coefficients and the calculated cosine coefficients.

The index for obtaining the correct cosine coefficient to plug into the equation may be generated, for example, with the pseudo-code shown in table 1.

TABLE 1

```
Index = (i+16) (2k+1);
Index = Index & 0x007f;                  // Keep index in range 0 . . . 127
If (Index>63) then Index = 128−Index;    // Fold 3rd & 4th quadrant;
(Index = 0 . . . 32) then {
Answer = Cosine_Table[Index];
}else{
Index = 64 − Index;                      // Fold 2nd quadrant;
Answer = Negative (Cosine_Table[Index]);
}
```

Although this method is memory efficient, it consumes some processor time for index calculation and other overhead such as conditional branches and instruction pipelines. As is understood by those of skill in the art, branch or jump instructions generally require more cycles to process than an add or multiply instruction. Using a convention digital signal processor (DSP), about 8–10 cycles are used per access to calculate the index. The index calculation is simpler if all 64 coefficients are stored, as per the first embodiment. It is a trade-off between memory space and processing/memory access time.

Figure 2:
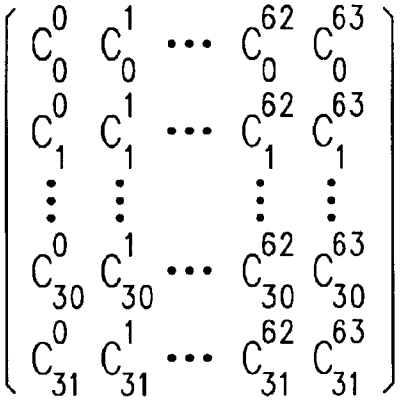
FIG. 2 illustrates a 32×64 matrix of cosine coefficients used by the MP3 decoder of FIG. 1.

Referring again to FIG. 2 to observe the cosine matrix, the matrix may be viewed as a set of 64 cosine series and then make use of the relation between adjacent cosine values. When i and k are put into the equation (1), we observe that the cosine coefficients are related. For example, for the first column of the matrix, when i=0 and k=0 . . . 31, the following cosine values are generated:

cos (π/64 * 16 * 1)
cos (π/64 * 16 * 3)
cos (π/64 * 16 * 5)
cos (π/64 * 16 * 7)
cos (π/64 * 16 * 9)
.
.
.
.
.
.
cos (π/64 * 16 * 61)
cos (π/64 * 16 * 63)

Figure 5:
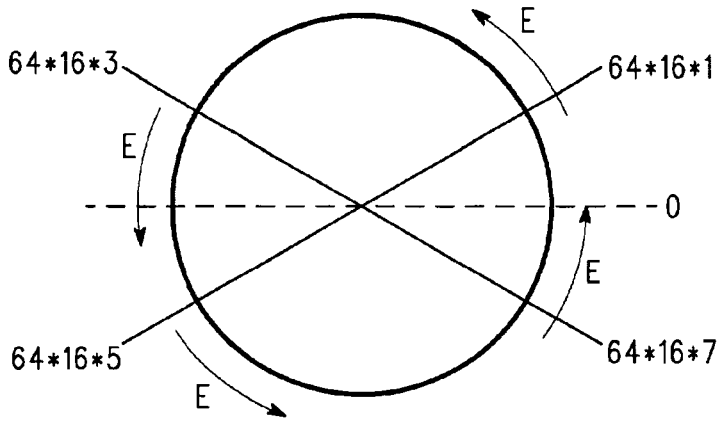
FIG. 5 is a graph illustrating a relationship of cosine values used in a sub-band decoder in accordance with a third embodiment of the present invention.

Referring now to FIG. 5, a graph of the relationship of the cosine values generated is shown. Note that the angle of the cosine value increased by a constant amount E. In this case, E=(π/64*16*2). The same relationship is true for other cosine series (columns) in the matrix, though the angle and the angle difference E may be some other value.

Since we know that the coefficients differ by a constant angle, we can derive the next coefficient using the previous coefficients. Using the equalities for sine and cosine:

$$COS(X+Y)=COS(X)*COS(Y)-SIN(X)*SIN(Y),$$

$$SIN(-Z)=-SIN(Z), \text{ and}$$

$$COS(-Z)=COS(Z)$$

Along a column where i is unchanged and k varies, suppose the n-th coefficient, C(n) equals COS(a), for some angle a. The next coefficient, C(n+1) equals COS(a+E), where E is the angle difference. The previous coefficient, C(n−1) equals COS(a−E). Using the equalities above, the equation may be rewritten as follows.

$$\begin{aligned} C(n+1)+C(n-1) &= \mathrm{COS}(a+E)+\mathrm{COS}(a-E) \\ &= \mathrm{COS}(a)\mathrm{COS}(E)-\mathrm{SIN}(a)\mathrm{SIN}(E)+ \\ &\quad \mathrm{COS}(a)\mathrm{COS}(-E)-\mathrm{SIN}(a)\mathrm{SIN}(-E) \\ &= \mathrm{COS}(a)\mathrm{COS}(E)-\mathrm{SIN}(a)\mathrm{SIN}(E)+ \\ &\quad \mathrm{COS}(a)\mathrm{COS}(E)+\mathrm{SIN}(a)\mathrm{SIN}(E) \\ &= 2\mathrm{COS}(a)\mathrm{COS}(E) \\ &= C(n)*2\mathrm{COS}(E) \end{aligned}$$

Hence, the next coefficient, C(n+1)=2 cos(E)*C(n)−C(n−1). Cos(E) is a constant, as long as i is unchanged. So, it is clear that for each i (each column), instead of storing 32 coefficients, we only need to store 3 coefficients, the last 2 samples: C(n−1) and C(n−2) and the adjustment value 2* cos(E). As there are 64 columns in the matrix, each column can be represented by 2 coefficients and an adjustment value, so the total number of storage locations required is 3*64 or 192 locations.

Although the third embodiment requires more memory space than the first and second embodiments above, which stored 64 and 33 coefficients, respectively, the third embodiment requires much less processor time to perform coefficient calculation than the first and second embodiments because the memory does not need to be accessed as often and calculation of the index (memory address) is simpler and also because fewer jumps (conditional and unconditional) must be executed. The number of coefficients stored in the third embodiment is 90.5% less than for the conventional 32×64 matrix.

Figure 6:
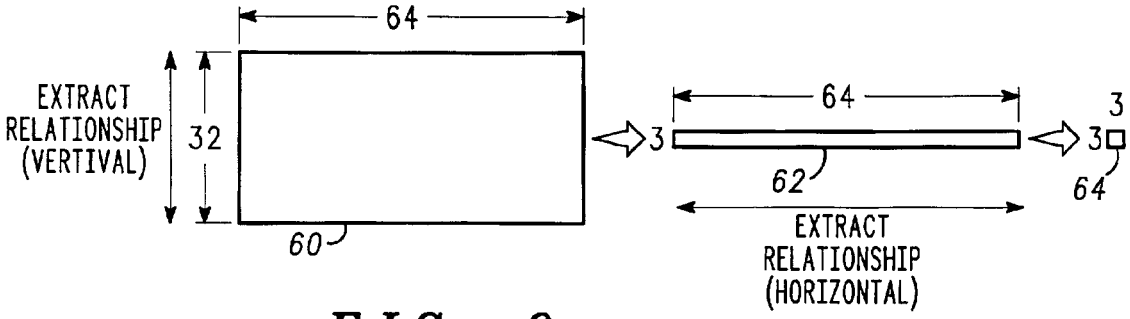
FIG. 6 is a diagram illustrating a reduction in the size of the matrix of cosine coefficients stored in a memory of a sub-band decoder in accordance with the present invention.

FIG. 6 is a diagram illustrating a reduction in the size of the matrix of cosine coefficients stored in a memory of a sub-band decoder in accordance with the present invention. FIG. 6 shows a conventional 32×64 matrix 60 of cosine coefficients and a reduced size 3×64 matrix 62 that includes two cosine coefficients (C(n−1), C(n−2)) for each column and an adjustment value cos(E) for each column.

Thus, the third embodiment of the present invention provides a method of performing an IDCT process that generates time domain samples ($V_i$) from frequency domain samples ($S_k$) using prestored cosine coefficients, where i and k are integer values defining columns and rows respectively of a matrix of cosine coefficients. The method comprises prestoring the cosine coefficients C(k−1,i) and C(k−2,i) for each column i of the matrix and prestoring an adjustment value cos(E(i)) for each column of the matrix. Then, the cosine coefficients for the remaining locations in the matrix are calculated using the prestored coefficients and the prestored adjustment values according to the equation C(k,i)=2 cos(E(i))*C(k−1,i)−C(k−2,i). The prestored adjustment values cos(E(i)) are calculated as cos(π/64*(i+16)*2).

Alternatively, instead of being used for sub-band synthesis, the third embodiment can be applied to other situations in which the cosine/sine coefficients in a matrix are related. That is, where the angle increases by a constant value. For example, the method may be used in the IMDCT process performed in layer 3 decoding. In such a case, the adjustment value cos(E(i)) is calculated as cos(π/72*(2i+19)*2) or as cos(π/24*(2i+7)*2), depending on the size of the matrix used, for example, 18×36 and 6×12, as will be understood by those of skill in the art.

In the IDCT process, the prestored and calculated cosine coefficients are used to generate the time domain samples ($V_i$) from the frequency domain samples ($S_k$) by solving the equation (1) above.

The third embodiment of the present invention may be modified in order to reduce the size of the stored coefficient matrix 62 (FIG. 6) even further. Analyzing the values stored in the matrix, we can see that the adjustment values cos(E(i)), as well as the coefficient values C(n−1) and C(n−2) increase by a constant amount from column to column. For example, observing the values stored in the 3×64 matrix 62, when i=0 to 63, the following values are stored:

| | i = 0 | i = 1 | i = 2 . . . | i = 63 |
|---|---|---|---|---|
| cos (E) | cos (π/64 * 16 * 2), | cos (π/64 * 17 * 2), | cos (π/64 * 18 * 2) | . . . |
| C (n − 1) | cos (π/64 * 16 * (2 * (−1) + 1)) | cos (π/64 * 17 * (2 * (−1) +1)) | cos (π/64 * 18 * (2 * (−1) + 1)) | . . . |
| C (n − 2) | cos (π/64 * 16 * (2 * (−2) + 1)) | cos (π/64 * 17 * (2 * (−2) + 1)) | cos (π/64 * 18 * (2 * (−2) + 1)) | . . . |

Thus, as i increases, the cosine angle increases by a constant amount of E'=(π/64*1*2). Similarly, the prestored rows of cosine coefficients increase by a constant amount. The C(n−1) row increases by cos(π/64*1*(2*(−1)+1)) and the C(n−2) row increases by cos(π/64*1*(2*(−2)+1)). The same method used to reduce the number of stored rows of coefficients can be used to reduce the number of stored columns of coefficients, by making use of the relationship between cosine coefficients horizontally. That is, for the columns of coefficients, only the columns for C(k,i−1) and C(k,i−2), and corresponding column adjustment values cos(E') need to be stored. In this manner, the size of the matrix is reduced from 3×64 to just 3×3 or 9 values.

Referring again to FIG. 6, the matrix reduction is shown beginning with the conventional 32×64 matrix 60 of cosine coefficients to the reduced size 3×64 matrix 62 that includes two cosine coefficients (C(n−1), C(n−2)) for each column and an adjustment value cos(E) for each column, to a 3×3 matrix 64 having just 4 coefficient values and 5 adjustment values.

A sub-band synthesis filter according to the modified third embodiment of the present invention, which requires storing only a 3×3 matrix, has been implemented and tested on a Motorola SC140 DSP core. The Motorola SC140 DSP core is a high performance DSP Core having four ALUs (Arithmetic & Logic Unit) and 2 AGUs (Address Generation Unit) that is commercially available from Motorola Inc. of Schaumburg Ill.

Figure 7:
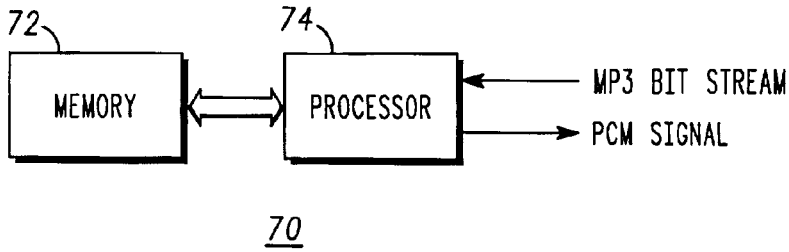
FIG. 7 is a high level block diagram of a digital filter in accordance with the present invention.

FIG. 7 shows a high level block diagram of a digital sub-band filter 70 according to the present invention. The filter 70 includes a memory 72 in which a predetermined number of cosine coefficients are stored and a processor 74, such as the above-mentioned Motorola SC140 DSP connected to the memory for processing the MP3 bit stream input, including accessing the prestored coefficients, calculating the other coefficients and generating the PCM signal.

During implementation, it was determined that the algorithm is processed faster if, instead of storing the coefficients C(n−1) and C(n−2) for each column, the coefficients C(n) and C(n−1) are stored, so that an initial calculation of C(n)

does not need to be performed. Then, as the other cosine values are calculated for that column, instead of calculating the current cosine value, the next cosine value is calculated. This allows for parallel calculations to be performed. More particularly, a first group of the cosine coefficients and a second group of the cosine coefficients are calculated in parallel using separate processors. The first group of cosine coefficients is cos(k+2,i) for k=0, 2, 4, . . . 14 and the second group of cosine coefficients is cos(k+2,i) for k=1, 3, 5, . . . 15.

In addition, the storage of coefficients can be further reduced by one-third because the value of the coefficients when k=0 is the same as when k=(−1).

As is apparent from the above, the present invention provides data structures for sub-band synthesis that require less memory space, yet still allow for efficient calculation of cosine coefficients. While the foregoing discussion describes the invention in terms of an MP3 decoder, it will be understood by those of ordinary skill in the art that the invention is applicable to other types of decoders. For example, the invention is applicable to other applications that require sub-band decoding, such as JPEG (Joint Photographic Experts Group) imaging systems like desktop video editing, digital still cameras, surveillance systems, video conferencing and other consumer products.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. In a digital filter for sub-band synthesis, a method of performing an IDCT (Inverse Discrete Cosine Transform) process that generates time domain samples ($V_i$) from frequency domain samples ($S_k$) using prestored cosine coefficients, where i and k are integer values defining columns and rows respectively of a matrix of cosine coefficients, the method comprising:

prestoring the cosine coefficients C(k−1,i) and C(k−2,i) for each column of the matrix;

prestoring an adjustment value cos(E(i)) for each column of the matrix; and calculating the cosine coefficients for the remaining locations in the matrix using the prestored coefficients and the prestored adjustment values in accordance with the equation $$C(k,i)=2\cos(E(i))*C(k-1,i)-C(k-2,i).$$

2. The method of claim 1, wherein the adjustment value cos(E(i)) is calculated as cos(π/64*(i+16)*2).

3. The method of claim 1, wherein the adjustment value cos(E(i)) is calculated as cos(π/72*(2i+19)*2).

4. The method of claim 1, wherein the adjustment value cos(E(i)) is calculated as cos(π/24*(2i+7)*2).

5. The method of claim 1, further comprising the step of:

generating sixty-four time domain samples ($V_1$) from thirty-two frequency domain samples ($S_k$) according to the equation, $$V_i=\sum_{k=0}^{31}\cos((\pi/64)(i+16)(2k+1))\times S_k$$

for i=0 to 63, using the prestored cosine coefficients and the calculated cosine coefficients.

6. The method of claim 5, wherein 128 coefficients are prestored and 64 adjustment values are prestored.

7. The method of claim 5, wherein the time domain samples is from an MPEG compliant audio sub-band.

8. In a digital filter for sub-band synthesis, a method of performing an IDCT (Inverse Pisorete Cosine Transform) process that generates time domain samples ($V_i$) from frequency domain samples ($S_k$) using prestored cosine coefficients, where i and k are integer values defining columns and rows respectively of a matrix of cosine coefficients, comprising the steps of:

prestoring the cosine coefficients C(k, i) and C(k−1, i) for each column at the matrix;

prestoring an adjustment value cos(E(i)) for each column of the matrix; and calculating the cosine coefficients for the remaining rows and columns of the matrix using the prestored coefficients and the prestored adjustment values in accordance with the equation, $$C(k+1,i)=2\cos(E(i))*C(k,i)-C(k-1,i).$$

9. The method of claim 8, further comprising the step of;

generating sixty-four samples ($V_i$) from thirty-two sub-band samples ($S_k$) according to the equation, $$V_i=\sum_{k=0}^{31}\cos((\pi/64)(i+16)(2k+1))\times S_k$$

for i=0 to 63 using the prestored cosine coefficients C(k,i) and C(k−1,i) and the cosine coefficients calculated using the adjustment value.

10. The method of claim 9, wherein the cosine coefficients for the next iterations are precalculated using the adjustment value in parallel with the calculation of the samples ($V_i$).

11. The method of claim 9, wherein a first group of the cosine coefficients and a second group of the cosine coefficients are calculated in parallel using separate processors.

12. The method of claim 11, wherein the first group of cosine coefficients is cos(k+2,i) for k=0, 2, 4, . . . 14 and the second group of cosine coefficients is cos(k+2,i) for k=1, 3, 5, . . . 15.

13. The method of claim 8, wherein the time domain samples is from an MPEG compliant audio sub-band.

14. The method of claim 8, wherein the number of prestored cosine coefficients is reduced by prestoring only two columns of the cosine coefficients and one column of the adjustment values cos(E) such that the size of the prestored matrix is 3×3 and the remaining cosine coefficients are calculated.

15. The method of claim 14, further comprising the step of:

generating sixty-four samples ($V_i$) from thirty-two sub-band samples ($S_k$) according to the equation, $$V_i = \sum_{k=0}^{31} \cos((\pi/64)(i+16)(2k+1)) \times S_k$$

for i=0 to 63 using the prestored cosine coefficients and the calculated cosine coefficients.

16. A digital filter for sub-band synthesis via an IDCT process that generates time domain samples ($V_i$) from frequency domain samples ($S_k$), where i and k are integer values defining columns and rows respectively of a matrix of cosine coefficients, the digital filter comprising:

a memory for prestoring the cosine coefficients C(k−1,i) and C(k−2,i) for each column of the matrix and an adjustment value cos(E) for each column of the matrix; and a processor for calculating the cosine coefficients for the remaining locations in the matrix using the prestored coefficients and the prestored adjustment values in accordance with the equation $$C(k,i)=2\cos(E(i)*C(k-2,i)-C(k1,i).$$

17. A digital filter for sub-band synthesis via an IDCT process that generates time domain samples ($V_i$) from frequency domain samples ($S_k$), where i and k are integer values defining columns and rows respectively of a matrix of cosine coefficients, the digital filter comprising:

a memory for prestoring the cosine coefficients C(k) and C(k−1,i) for each column of the matrix and an adjustment value cos(E(i)) for column of the matrix; and a processor for calculating the cosine coefficients for the remaining rows and columns of the matrix using the prestored coefficients and the prestored adjustment values in acoordance with the equation, $$C(k+1,i)=2\cos(E(i))*C(k,i)-C(k-1,i).$$

* * * * *